US005079875A

United States Patent [19]

Unno et al.

[11] Patent Number: 5,079,875

[45] Date of Patent: Jan. 14, 1992

[54] SEGMENTEE GRINDING WHEEL

[75] Inventors: Kunihiko Unno; Tomoyasu Imai, both of Kariya; Hajime Fukami, Nagoya; Akimitsu Kamiya, Okazaki; Shinji Soma, Handa, all of Japan

[73] Assignee: Toyoda Koki Kabushiki Kaisha, Kariya, Japan

[21] Appl. No.: 617,181

[22] Filed: Nov. 23, 1990

[30] Foreign Application Priority Data

Nov. 23, 1989 [JP] Japan ..... 1-303970
Feb. 9, 1990 [JP] Japan ..... 2-030994

[51] Int. Cl.[5] ..... B23F 21/23

[52] U.S. Cl. ..... 51/206 R; 51/209 R; 51/295; 51/293; 51/299

[58] Field of Search ..... 51/206 R, 209 R, 295, 51/293, 298, 299

[56] References Cited

U.S. PATENT DOCUMENTS 843,624 2/1907 Peirce ..... 51/209 R
3,686,800 8/1972 Rue et al. ..... 51/206 R
3,850,590 11/1974 Chalkley et al. ..... 51/295
4,446,657 5/1984 Asaeda et al. ..... 51/206 R

*Primary Examiner*—James G. Smith
*Assistant Examiner*—Lawrence Cruz
*Attorney, Agent, or Firm*—Oblon, Spivak, McClelland, Maier & Neustadt

[57] ABSTRACT

A grinding wheel for use in a grinding machine, wherein a plurality of grinding tips are bonded on the periphery of a wheel core having a disk-like shape using a bond which forms a bonding layer between the wheel core and the grinding tips. The grinding wheel is further provided with means for preventing coolant from entering inside of the abrasive layer and/or bonding layer, thereby preventing the bonding layer from being swelling by the coolant. In a first embodiment, the preventing means is composed of rubber layers formed on the both side surfaces of the grinding wheel at the places corresponding to the radial position of the bonding layer. In another embodiment, the preventing means is composed of water-repellant material capable of repelling water. Such material is composed of silicon or fluorine resin and is soaked into the grinding tips.

3 Claims, 3 Drawing Sheets

SEGMENTEE GRINDING WHEEL

BACKGROUND OF THE INVENTION

1. Field of the Invention

The present invention relates to a segmentee grinding wheel which is used in a grinding machine and the like.

2. Discussion of the Prior Art

The Japanese laid open utility model application 63-100014 discloses a segmentee grinding wheel used in a grinding machine. Such segmentee grinding wheel is generally composed of a metal core and a plurality of segmented grinding tips bonded on the peripheral surface of the metal core using bond.

Since water-soluble epoxy resin is used as the bond in such segmentee grinding wheel, the bonding layer thereof tends to be swelled by coolant during grinding operations, thereby causing decrease of the bonding stiffness. Further, the bonding stiffness gradually decreases during usage, thereby increasing the possibility of causing the segmented grinding tips to drop from the metal core.

Especially, such problem often occurs in cases where the segmented grinding tips are composed of abrasive grains and vitrified bonding matrix, because such segmented grinding tips contain a lot of pores. Namely, water-soluble coolant enters the pores during grinding operations, thereby causing the bonding layer to be soaked with the coolant.

SUMMARY OF THE INVENTION

Accordingly, it is an object of the present invention to provide an improved segmentee grinding wheel capable of preventing the bonding layer from being soaked with coolant, thereby increasing the safety.

Briefly, according to the present invention, the object is achieved by providing a segmentee grinding wheel which is provided with a plurality of grinding tips bonded on the outer periphery of a wheel core using bond which form a bonding layer between the grinding tips and the wheel core. The segmentee grinding wheel is further provided with means for preventing invasion of coolant to the bonding layer. With this configuration, the coolant is prevented from invading the bonding layer.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENT

Figure 2:
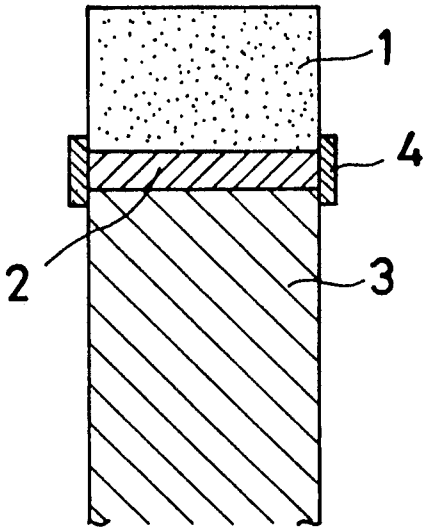
FIG. 2 is a sectional view taken on line II—II of FIG. 1.
Figure 1:
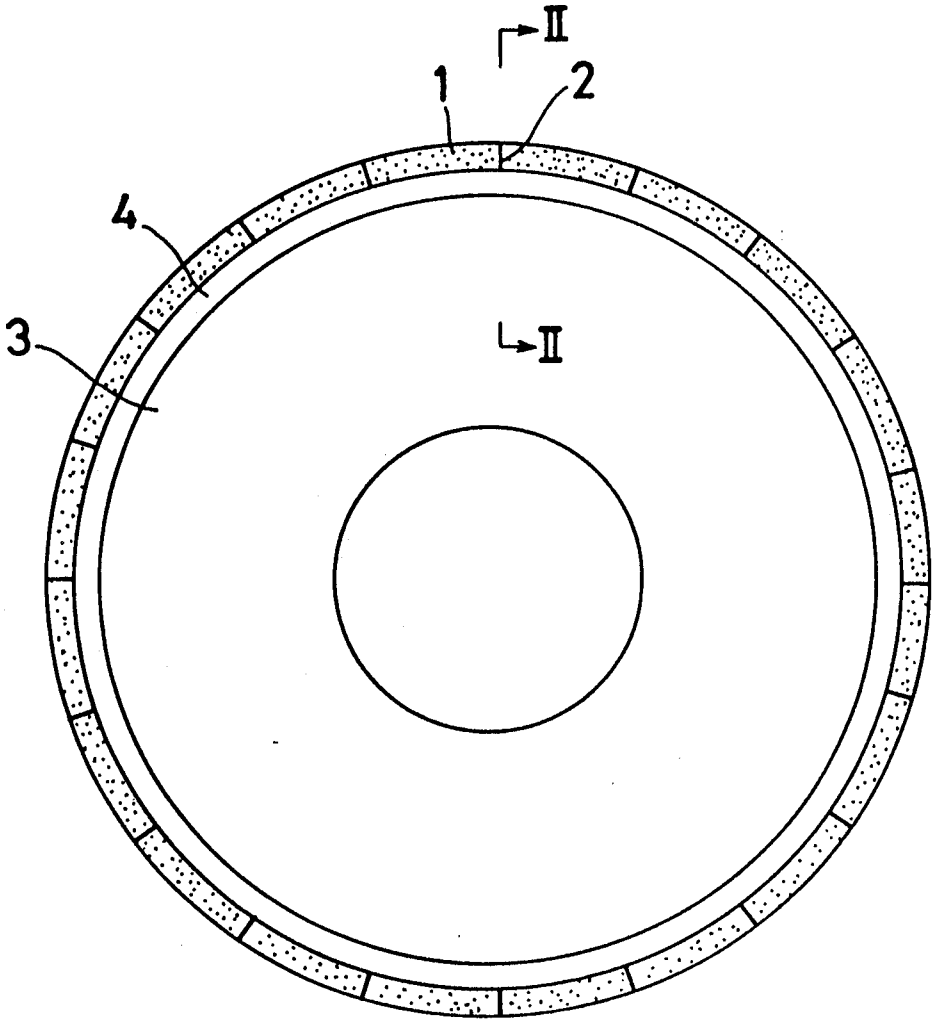
FIG. 1 is a side view of a segmentee grinding wheel according to a first embodiment of the present invention.

Referring now to the drawings and particularly, to FIG. 1 thereof showing the first embodiment of the present invention, there is shown a circular wheel core 3 made of metal. A plurality of segmented grinding tips 1 are bonded on the periphery surface of the wheel core 3 using bond made of epoxy resin. Also, bond is filled up in circumferential spaces formed between every two adjacent grinding tips 1. As a result, bonding layer 2 is formed between the grinding tips 1 and wheel core 3 and between every two adjacent grinding tips 1.

Further, circular rubber layers 4 made of silicone or urethane are formed on the both side surfaces of the grinding wheel so as to cover the bonding layer 2 between the grinding tips 1 and the wheel core 3. The rubber layers 4 are formed by applying melted rubber using a brush, or is formed during manufacturing process of the grinding wheel. In later case, a circular depression is formed on a inside surface of respective molds, which are used for manufacturing the grinding wheel, at locations corresponding to the bonding layer 2, and melted rubber is poured into the depressions before the wheel core 3 and the grinding tips 1 are united in the molds. The grinding tips 1 is made of super-hard abrasive grains such as CBN abrasive grains which are bonded each other using vitrified bonding matrix. The grinding tips 1 are manufactured by following steps. First, abrasive grains and vitrified bonding matrix are mixed, and then formed in a predetermined arc shape using a press. After that, the mixed grains and bonding matrix are baked, thereby obtaining the grinding tips 1.

By covering the side surfaces of the bonding layer 2 with the rubber layers 4, it is possible to prevent coolant form entering into the bonding layer 2, thereby preventing the stiffness of the bonding layer 2 from being deteriorated.

Although the rubber layers 4 covers only the side surfaces of the bonding layer between the grinding tips 1 and the wheel core 3, the rubber layers 4 can be formed to cover the side surfaces of the bonding layers between every two adjacent grinding tips 1.

Figure 3:
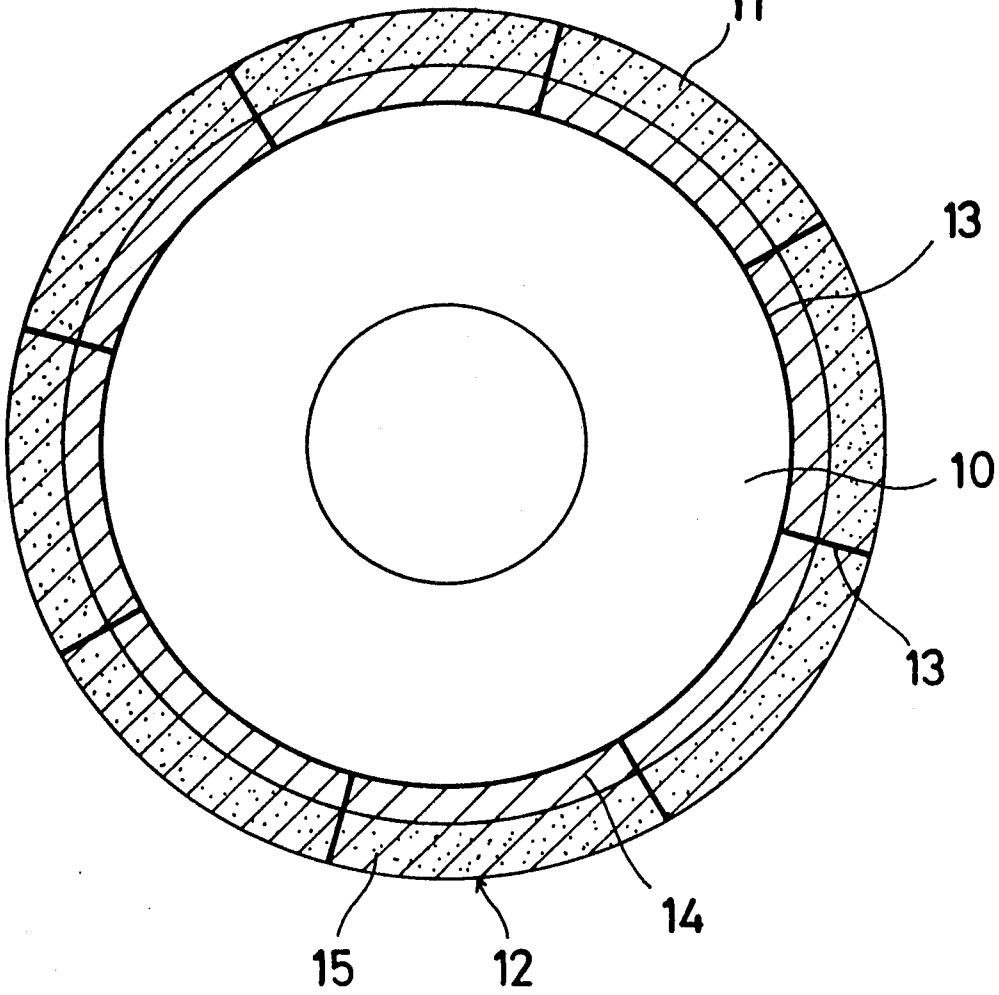
FIG. 3 is a side view of a segmentee grinding wheel according to a second embodiment of the present invention.
Figure 4:
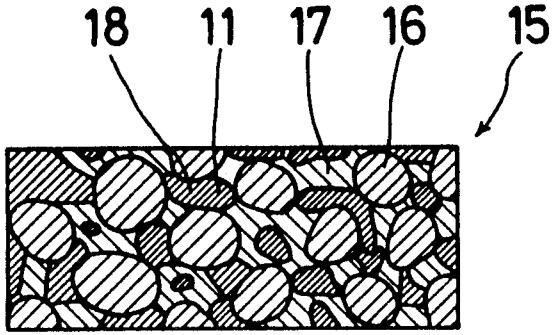
FIG. 4 is a view illustrating abrasive grains bonded by vitrified bond.

FIGS. 3 and 4 illustrate a segmentee grinding wheel according to the second embodiment of the present invention. The grinding wheel is also composed of a metal core 10 and a plural grinding tips 12 attached to the outer periphery of the metal core 10 using bond made of epoxy resin. Each of the grinding tips 12 is composed of a base layer 14 and a grinding abrasive layer 15. The base layers 14 are made from ceramic powders, and the abrasive layers 15 are made from super-hard abrasives grains such as diamonds and CBNs. Ceramic powders are formed in a predetermined arc shape using a press to constitute the base layer 14. The super-hard abrasives 16 are mixed with vitrified bonding matrix 17, and then are formed in a predetermined arc shape using a press to constitute the abrasive layers 15. After that, such base layers 14 and abrasive layers 15 are baked in a condition that the abrasives layers 15 are put on the base layers 14 so as to be united to form the grinding tips 1. Since both of the base layers 14 and abrasive layers 15 are made by powders, a lot of pares 11 are formed in the base layers 14 and abrasive layers 15.

The grinding tips 12 manufactured by above-mentioned process are bonded on the periphery of the metal core 10 to constitute a segmentee grinding wheel.

According to the second embodiment of the present invention, water-repellant material capable of repelling water, such as silicone or fluorine resin, is applied to the grinding wheel manufactured by above-mentioned process. Namely, the water-repellant material is applied to the grinding wheel by putting the grinding wheel into the water-repellant material or by splaying such material on the outer surface of the grinding wheel. As a result, the water-repellant material 18 enters into the pores 11 of the base layers 14 and abrasive layers 15, as shown in FIG. 4, thereby preventing coolant from entering inside of the grinding wheel. Therefore, the bonding layer 13 is prevented form being swelled by coolant.

Although segmented grinding tips are bonded on the periphery of the metal core in the second embodiment, this invention can be used in a grinding wheel in which a abrasive layer having a cylindrical shape is boned on the periphery of the metal core.

Further, the present invention can be used in other types of grinding wheels, wherein other types of bonding matrix is used for binding abrasive grains in grinding tips, such as metal bonded grinding wheels and resin bonded grinding wheels.

Obviously, numerous modifications and variations of the present invention are possible in light of the above teachings. It is therefore to be understood that within the scope of the appended claims, the present invention may be practiced otherwise than as specifically described herein.

What is claimed is:

1. A grinding wheel for use in a grinding machine, said grinding wheel comprising:

a wheel core having a disk-like shape;

an abrasive layer disposed at the periphery of said wheel core;

a bonding layer disposed between said wheel core and said abrasive layer for bonding said abrasive layer to the periphery of said wheel core; and rubber layers applied to both of side surfaces of said grinding wheel at places corresponding to the radial positions of said bonding layer to avoid penetration of coolant into said bonding layer.

2. A grinding wheel as recited in claim 1, wherein said abrasive layer is composed of a plural segmented grinding tips.

3. A grinding wheel as recited in claim 2, wherein said grinding tips are composed of super-hard abrasive grains and vitrified bonding material.

* * * * *